US009322130B2

(12) United States Patent
Jung

(10) Patent No.: US 9,322,130 B2
(45) **Date of Patent: *Apr. 26, 2016**

(54) TEXTILE FABRIC SHEET HAVING STAIN AND LIQUID RESISTANCE AND THE PREPARATION METHOD THEREOF

(71) Applicant: Soon Kie Jung, Saddle River, NJ (US)

(72) Inventor: Soon Kie Jung, Saddle River, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/493,768

(22) Filed: Sep. 23, 2014

(65) Prior Publication Data

US 2015/0017854 A1 Jan. 15, 2015

Related U.S. Application Data

(63) Continuation-in-part of application No. 13/468,560, filed on May 10, 2012, now Pat. No. 9,103,067, which is a continuation-in-part of application No. 13/197,986, filed on Aug. 4, 2011, now Pat. No. 8,795,780.

(51) Int. Cl.

| | |
|---|---|
| ***D06M 15/564*** | (2006.01) |
| ***D06M 15/356*** | (2006.01) |
| ***D06M 15/643*** | (2006.01) |
| ***D06M 15/21*** | (2006.01) |
| ***D06N 3/18*** | (2006.01) |
| ***D06N 3/14*** | (2006.01) |
| ***D06N 3/00*** | (2006.01) |
| ***D06N 3/04*** | (2006.01) |
| *D06M 101/02* | (2006.01) |
| *D06M 101/16* | (2006.01) |

(52) U.S. Cl.

CPC ..... *D06M 15/564* (2013.01); *D06M 15/21* (2013.01); *D06M 15/3568* (2013.01); *D06M 15/643* (2013.01); *D06N 3/0063* (2013.01); *D06N 3/042* (2013.01); *D06N 3/047* (2013.01); *D06N 3/14* (2013.01); *D06N 3/143* (2013.01); *D06N 3/183* (2013.01); *D06N 3/186* (2013.01); *D06M 2101/02* (2013.01); *D06M 2101/16* (2013.01); *D06M 2200/01* (2013.01); *D06M 2200/12* (2013.01); *D06N 2209/121* (2013.01); *D06N 2209/128* (2013.01); *D06N 2209/147* (2013.01); *D06N 2209/1685* (2013.01); *Y10T 442/2098* (2015.04); *Y10T 442/2107* (2015.04)

(58) Field of Classification Search

USPC ..... 442/79, 80, 93

See application file for complete search history.

(56) References Cited

U.S. PATENT DOCUMENTS

| | | | | |
|---|---|---|---|---|
| 4,265,962 | A | 5/1981 | May | |
| 4,430,381 | A * | 2/1984 | Harvey | A01N 37/02 106/15.05 |
| 5,747,392 | A | 5/1998 | Xiao et al. | |
| 5,902,753 | A | 5/1999 | DeMott et al. | |
| 7,485,588 | B2 | 2/2009 | Wang et al. | |
| 9,103,067 | B2 * | 8/2015 | Jung | D06N 3/183 |
| 2003/0041808 | A1 | 3/2003 | Wulforst et al. | |
| 2008/0124368 | A1 | 5/2008 | Sarangapani | |
| 2008/0220224 | A1 | 9/2008 | Tokumoto et al. | |
| 2009/0077704 | A1 | 3/2009 | Duncan et al. | |
| 2013/0035012 | A1 | 2/2013 | Jung | |

OTHER PUBLICATIONS

International Searching Authority, International Search Report issued in corresponding International Application No. PCT/KR2012/003513, dated Nov. 23, 2012.

International Searching Authority, Search Report dated Jun. 29, 2015 in counterpart International Patent Application No. PCT/US2014/056945.

* cited by examiner

*Primary Examiner* — Lynda Salvatore

(74) *Attorney, Agent, or Firm* — Sughrue Mion, PLLC

(57) ABSTRACT

Provided are a textile fabric sheet having stain and liquid resistance including (a) a fabric substrate, (b) a first polyurethane coating layer formed on a first surface of the fabric substrate; (c) a second aqueous acrylic coating layer formed on the first coating layer of the polyurethane coating layer; and (d) a third stain-resistant coating layer formed on the second aqueous acrylic coating layer and a method of preparing the same. Thus, a texture characteristic of the fabric substrate itself can be exhibited, and due to the polyurethane coating layer, the aqueous acrylic coating layer and the stain-resistant coating layer stacked in three steps, excellent water resistance, stain resistance and air permeability can be exhibited.

15 Claims, 8 Drawing Sheets

TEXTILE FABRIC SHEET HAVING STAIN AND LIQUID RESISTANCE AND THE PREPARATION METHOD THEREOF

CROSS-REFERENCE TO RELATED APPLICATIONS

This application is a continuation-in-part of U.S. patent application Ser. No. 13/468,560 (pending) filed May 10, 2012, which is a continuation-in-part of U.S. patent application Ser. No. 13/197,986 (patented as U.S. Pat. No. 8,795,780), filed Aug. 4, 2011, the disclosures of which are incorporated herein by reference in their entirety.

TECHNICAL FIELD

This invention relates to a textile fabric sheet having stain and liquid resistance and a method of preparing the same, and more particularly, to a textile fabric sheet with excellent stain resistance, wear resistance as well as liquid barrier characteristics prepared by sequentially forming a polyurethane skin layer, acrylic coating layer and a stain-resistant coating layer on at least one surface of the fabric substrate and a method of preparing the same.

BACKGROUND

Generally, a textile fabric for interior application is being used for several years once installed. When they are contaminated by stains and spills, it is difficult to clean them every time, and these stains may leave bad marks on the surface, not good for aesthetics. Common stains include the ones caused by ball point pens, various liquids, solid or dust, impurities or other organic materials. Liquid stains or spills often seep through the open texture of the textile fabrics into the bottom cushion/foam underneath, and cause unsanitary environment in public places like hospitals, hotels, and restaurants.

To solve the above-mentioned issues, conventional stain resistant textiles are treated with stain resistant coating such as a water repellent on the surface, and, if necessary, together with moisture barrier layer in the back of the fabric. However, when stain resistant coating is simply treated on the surface of the textile fabric, the effect is quite limited, not as good as other solid surface products, due to an open constructional characteristic and the absorption property of the textile fabric. Thus, it has been constantly required to develop a true stain resistant textile fabric that can be easily cleaned leaving no bad marks behind regardless of the type of stains.

SUMMARY

This invention has been made in an effort to provide a textile fabric sheet having an excellent stain, liquid and wear resistance, not sacrificing a true textile feel, which includes a skin layer—capable of providing a solid material base, on which stain resistance coating can be applied, acting as a liquid barrier with added wear resistance characteristics—and a coating layer on top having stain resistance and a method of preparing the same.

An exemplary embodiment of the present invention provides a textile fabric sheet having stain and liquid resistance, including: (a) a fabric substrate; (b) a first polyurethane coating layer formed on the first surface of the fabric substrate; (c) a second aqueous acrylic coating layer formed on the first polyurethane coating layer; and (d) a third stain-resistant coating layer formed on the second aqueous acrylic coating layer.

The fabric substrate may be a woven or non-woven fabric composed of at least one selected from the group consisting of a polyester fiber, a viscose rayon fiber, a polyamide fiber, a polyurethane fiber, an acrylic fiber, a polyolefin fiber and a cellulose fiber.

According to a preferred embodiment of the present invention, an applying amount of the first polyurethane coating layer may range from 10 g/m$^2$ to 30 g/m$^2$; an applying amount of the second aqueous acrylic coating layer may range from 25 g/m$^2$ to 75 g/m$^2$; and an applying amount of the third stain-resistant coating layer may range from 10 g/m$^2$ to 30 g/m$^2$.

Meanwhile, in order to achieve the aforesaid technical tasks, the fabric sheet having stain and liquid resistance of the present invention is manufactured by comprising: (i) knife-coating a polyurethane coating composition on a first surface of the fabric substrate at least once and drying the composition; (ii) knife-coating an aqueous acrylic coating composition on a top of the above-coated first polyurethane coating layer at least once and drying the composition; and (iii) knife-coating a stain-resistant coating composition on a top of the above-coated second aqueous acrylic coating layer at least once and drying the composition.

In each of steps (i) to (iii), it is preferable to conduct knife-coating at least once, wherein an width angle of the knife is preferably in the range of 50° to 150°.

According to a preferable embodiment of the present invention, a polyurethane coating composition may comprise: a polyurethane resin in an amount of 60-80 parts by weight; a curing agent in an amount of 0.1-3 parts by weight; and an organic solvent in an amount to balance the composition to 100 parts by weight, based on 100 parts by weight of the coating composition.

Further, in step (iii) above, the aqueous acrylic coating composition may comprise: an acrylic resin in an amount of 30-50 parts by weight; a softening agent in an amount of 1-5 parts by weight; an antifoaming agent in an amount of 1-5 parts by weight; a water repellent (WR) agent in an amount of 1-5 parts by weight; and water in an amount to balance the composition to 100 parts by weight, based on 100 parts by weight of the coating composition.

Further, in step (iii) above, the stain-resistant coating composition may include a mixture of (i) a polyurethane resin, (ii) a silicone resin, (iii) inorganic particles, and (iv) an organic solvent. Here, the stain-resistant coating composition may comprise (i) a polyurethane resin in an amount of 20-40 parts by weight, (ii) a silicone resin in an amount of 1-10 parts by weight, (iii) inorganic particles in an amount of 1-10 parts by weight, and (d) an organic solvent in an amount to balance the stain-resistant coating composition to 100 parts by weight, based on 100 parts by weight of the coating composition.

In one embodiment of the method of preparing a textile fabric sheet according to the present invention, further comprises step of dip coating the fabric substrate with a coating solution containing a water repellent or an oil repellent and then drying it, before or after step (i).

According to the exemplary embodiments of the present invention, the textile fabric sheet having stain and liquid resistance can exhibit a texture characteristic of a fabric substrate itself and also exhibit water resistance, stain resistance and wear resistance due to the first polyurethane coating layer, the second acrylic coating layer and the third stain-resistant coating layer formed in three layers.

In addition, according to the exemplary embodiments of the present invention, when used as surface finishing materials of furniture or interior, the textile fabric sheet is less flawed due to good surface hardness, and is not easily stained by stains in everyday life, and the stains can be easily removed.

Moreover, according to the exemplary embodiments of the present invention, since the first polyurethane coating layer and the second acrylic coating layer prevents a liquid from permeating into the fabric sheet, unlike a conventional stain resistant product, a separate moisture barrier is not needed, which is more economical.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE INDICATIONS IN THE DRAWINGS

Figure 1:
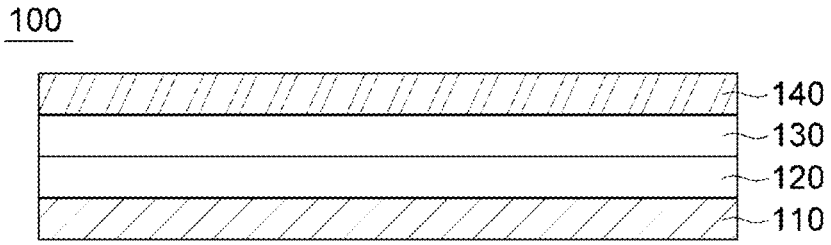
FIG. 1 to FIG. 3 are a cross-sectional view showing a configuration of a textile fabric sheet having stain and liquid resistance according to an exemplary embodiment of the present invention.

110: a fabric substrate
120: a first polyurethane coating layer
121: a water repellent layer
122: an oil-based acrylic back-coating layer
130: a second aqueous acrylic coating layer
140: a third stain-resistant coating layer

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

The exemplary embodiments of the present invention will be described in detail with reference to the accompanying drawings.

Hereinafter, the expression "B formed above (or below) A" or "B formed on A" used herein includes all of cases when B is directly attached to a top or bottom surface of A, when B is attached to a top or bottom surface of A by means of an adhesive layer or pressure-sensitive adhesive layer, and when at least one separate layer is formed on a top or bottom surface of A and B is attached to the separate layer directly or by means of an adhesive layer or a pressure-sensitive adhesive layer, etc.

Figure 2:
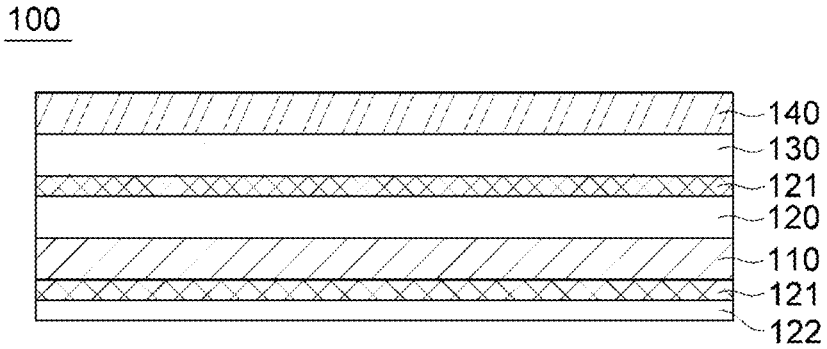
Figure 3:
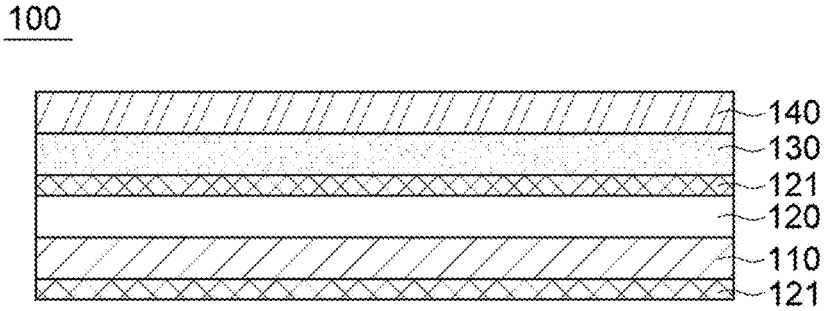

FIG. 1 to FIG. 3 are a cross-sectional view of a textile fabric sheet having stain and liquid resistance according to an exemplary embodiment of the present invention. Referring to FIGS. 1-3, a textile fabric sheet having stain and liquid resistance 100 may sequentially comprise a fabric substrate 110 woven with fabric, and a first polyurethane coating layer 120, a second acrylic coating layer 130 and a stain-resistant coating layer 140 formed on one surface of the fabric substrate 110.

A kind of the fabric substrate 110 used herein is not particularly limited, and thus a conventional woven or non-woven fabric known to those skilled in the art may be used.

The woven or non-woven fabric may be prepared with synthetic resin fibers such as a polyester fiber, a viscose rayon fiber, a polyamide fiber, a polyurethane fiber, an acrylic fiber, a polyolefin fiber and a cellulose fiber, alone or in combination; cotton (e.g., thread made of cotton); or a combination of the synthetic resin fiber and cotton. Among these, a woven fabric prepared with a mixture of the polyester fiber or the viscose rayon fiber, the polyamide fiber, the polyester fiber and the cotton, or the polyester fiber and the viscose rayon fiber is preferably used, but the present invention is not limited thereto. A polyester textile material is woven using a polyester fiber stretched to have very little or reduced elongation, and has high tension, low absorption and excellent drug resistance. In addition, an elastic fiber material such as spandex may be used.

A method of preparing woven or non-woven fabric using the above-mentioned material may be, but is not particularly limited to, a general paper-manufacturing or weaving process.

The fabric substrate 110 may have a thickness of 0.3 to 2 mm, but the present invention is not limited thereto.

In the present invention, the first polyurethane coating layer 120 formed on the surface of the fabric substrate may closely penetrate into the fabric substrate 110 while maintaining a web structure of the above mentioned fabric substrate 110 and may be thinly coated, thus exhibiting an original texture characteristic of the textile itself. In addition, the first polyurethane coating layer 120 may prevent damage to the fabric substrate 110, and exhibit improved wear resistance and excellent water resistance because liquid does not permeate thereinto.

The first polyurethane coating layer 120 may be formed using a conventional polyurethane resin known in the art. Non-limiting examples of the polyurethane resin may include polyether polyurethane, polyester polyurethane, polycarbonate polyurethane, polyetherester polyurethane, polyethercarbonate polyurethane, polycaprolactone polyurethane, hydrocarbon polyurethane, alicyclic polyurethane, aromatic polyurethane, or a combination of at least one thereof.

Further, an applying amount of the polyurethane resin in the first polyurethane coating layer (120) is preferably in the range of 10 g/m$^2$ to 30 g/m$^2$, more preferably, in the range of 10 g/m$^2$ to 20 g/m$^2$. When the applying amount of the first polyurethane coating layer is in the above-mentioned range, the first polyurethane coating layer exhibits an excellent coating effect, and has a fast drying speed and good workability.

For reference, an applying amount of each coating layer formed on the fabric substrate in the present invention is based on the amount applied to a fabric (polyester) 129 g/m$^2$, and may appropriately vary depending on the weight of the fabric to be used.

The first polyurethane coating layer 120 may be a transparent type or a colored type including a pigment. Generally, the fabric substrate 110 may have various colors and patterns, and thus a transparent polyurethane coating layer is preferably used to show such color and pattern as they appear originally. Here, a pigment may be any one known in the art, for example, a pigment containing an organic or inorganic component, without limitation.

The present invention is characterized by adding a second aqueous acrylic coating layer 130 as a medium layer between the first polyurethane coating layer 120 and the third stain-resistant coating layer 140.

The second aqueous acrylic coating layer 130 coupled between the first polyurethane coating layer 120 and the third stain-resistant coating layer 140 can exhibit liquid penetration resistance and a soft textile characteristic and further increase water resistance and stain resistance.

The second acrylic coating layer 130 may be formed by using a normal aqueous acrylic resin known in the relevant art without limitation.

The second aqueous acrylic coating layer (c) may be formed by using an acrylic resin, which is a basic resin, alone or additionally comprising a normal additive known in the relevant art. For example, it is preferable to add a softening agent and an antifoaming agent to the aqueous acrylic resin.

In the present invention, an applying amount of the second aqueous acrylic coating layer (c) may range from 25 g/m$^2$ to 75 g/m$^2$, preferably, from 30 g/m$^2$ to 60 g/m$^2$. When the applying amount of the second acrylic coating layer is in the above-mentioned range, the second acrylic coating layer exhibits an excellent coating effect, and has a fast drying speed and good workability.

As well as the aforesaid first polyurethane coating layer 120, the second acrylic coating layer 130 may be a transparent type or a colored type including a pigment. Here, a pigment may be any one known in the art, for example, a pigment containing an organic or inorganic component, without limitation.

The third stain-resistant coating layer 140 of the present invention may be formed on the first polyurethane coating layer 120 and the second acrylic coating layer 130, and thus may exhibit excellent stain resistance and wear resistance.

The third stain-resistant coating layer 140 may be formed using a general stain-resistant material known in the art. For example, a silicone resin may be used alone or a mixture of a silicone resin and a polyurethane resin may be used. The silicone resin or polyurethane resin may be a conventional one known in the art without limitation. The silicone resin may have an average viscosity of 1000 to 20000 cps, but the present invention is not limited thereto. Further, the polyurethane resin may have an average viscosity of 1,000 to 20,000 cps/25° C., preferably 3,000 to 15,000 cps/25° C., more preferably 8,000 to 15,000 cps/25° C.

The third stain-resistant coating layer 140 may comprise general inorganic particles known in the art. Non-limiting examples of inorganic particles which can be used herein include silica ($SiO_2$), alumina ($Al_2O_3$), $SnO_2$, MgO, CaO, $TiO_2$ or mixture thereof.

The third stain-resistant coating layer 140 may be formed by mixing a polyurethane resin; a silicone resin; and inorganic particles, or by mixing a silicone resin with at least one additive selected from the group consisting of a polyurethane resin, oil, platinum and fluorine.

Here, an applying amount of the third stain-resistant coating layer 140 may range from 10 g/m$^2$ to 30 g/m$^2$, preferably, from 15 g/m$^2$ to 25 g/m$^2$. When the applying an amount of the third stain-resistant coating layer is in the above-mentioned range, the third stain-resistant coating layer exhibits an excellent coating effect, and has a fast drying speed and good workability.

Meanwhile, the textile fabric sheet having stain and liquid resistance according to the present invention may further comprise a water repellent layer 121 between the first polyurethane coating layer 120 and the second aqueous acrylic coating layer 130 and on the second surface of the fabric substrate.

The water repellent layer 121 may use a normal water-repellent agent known in the art without limitation. For example, a water repellent agent may be a silicone-based water repellent agent or a fluorine-based water repellent agent. The fluorine-based water repellent agent is preferable and may exhibit strong water repellent by forming a fluorine film on a fabric surface and lowering surface tension. Since the fluorine-based water repellent agent has oil repellent as well as water repellent, it has a more advantageous effect over other water repellent agents and may be used as an anti-dust agent. Examples of an available fluorine-based water repellent agent may include perfluoro acrylate-based copolymer.

The water repellent layer 121 preferably comprises a softening agent, an aqueous acrylic binder and an anti-static agent in addition to the water repellent agent. Here, the components and amounts thereof are not specifically limited, and may be appropriately adjusted within the range known in the art.

In the present invention, an applying amount of the water repellent layer (121) may range from 1 g/m$^2$ to 10 g/m$^2$, preferably, 1 g/m$^2$ to 5 g/m$^2$.

Further, the textile fabric sheet having stain and liquid resistance according to the present invention may further comprise an oil-based acrylic back-coating layer 122, the component of which is different from that of the second aqueous acrylic coating layer 130, on the water repellent layer 121 formed on the second surface of the fabric substrate 110.

The oil-based acrylic back-coating layer 122 may be formed by using a normal oil-based acrylic resin known in the art without limitation.

The acrylic back-coating layer 122 may be formed by using an acrylic resin, which is a basic resin, alone or additionally comprising a normal additive known in the art, e.g., preferably, a styrene-butadiene rubber (SBR) and an organic solvent.

Here, an applying amount of the acrylic back-coating layer 122 may range from 1 g/m$^2$ to 15 g/m$^2$, preferably, 5 g/m$^2$ to 15 g/m$^2$. When the applying amount of the acrylic back-coating layer 122 is in the above-mentioned range, an excellent liquid penetration resistance may be exhibited.

The textile fabric sheet having stain and liquid resistance according to the exemplary embodiment of the present invention may be prepared according to a method to be described below, but the present invention is not particularly limited thereto.

In the exemplary embodiment, the method may include (i) knife-coating a polyurethane coating composition on a first surface of the fabric substrate at least once and drying the composition; (ii) knife-coating an aqueous acrylic coating composition on a top of the above-coated first polyurethane coating layer at least once and drying the composition; and (iii) knife-coating a stain-resistant coating composition on a top of the above-coated second aqueous acrylic coating layer at least once and drying the composition.

Knife coating is one of coating methods used when a fabric material is laminated. That is, a fabric substrate is provided on a revolving roller to move, a liquid coating composition is provided on the moving fabric substrate, and the provided liquid coating composition passes through a knife extending in a width direction and formed on the roller. Here, the thickness of the coating layer is determined according to a height of the knife.

Meanwhile, when the first polyurethane coating layer 120 and the second acrylic coating layer 130 are very thick, the final textile fabric sheet becomes rigid, and thus is deteriorated in texture as textiles. Thus, in the present invention, a polyurethane coating composition, an aqueous acrylic coating composition and a stain-resistant coating composition are sequentially coated on a fabric substrate 110 using knife coating. Here, the above coating composition may be thinly coated at least twice to maintain air permeability of the fabric substrate and soft texture.

In the exemplary embodiment, each of the polyurethane coating composition, the aqueous acrylic coating composition and the stain-resistant coating composition may be knife-coated once or at least twice. Here, a diameter angle of the knife, a thickness of the knife and a viscosity of the coating composition may be appropriately controlled in consideration of texture, wear resistance and stain resistance of the final fabric sheet of the present invention.

During the knife coating, the diameter angle of the knife may range from 50 to 150 degrees, preferably 70 to 110 degrees. Generally, as the knife angle is decreased and the knife thickness is increased, a coating layer to be formed has a larger thickness. Considering this, when the coating composition is coated at least twice, the diameter angle of the knife in the first coating step may be larger than the diameter angle of the knife in the second coating step, and thus the coating composition may be thinly coated. Actually, the thickness of the coating layer to be formed may be controlled by adjusting the viscosity of the coating composition, the knife angle or the knife thickness, and thus the first polyurethane coating layer, the second acrylic coating layer and/or the third stain-resistant coating layer may be thinly and uniformly applied to a surface of the fabric substrate to have a predetermined thickness. In addition, an applying amount of the coating composition may be reduced, and excellent adhesive strength may be ensured.

The polyurethane coating composition according to the exemplary embodiment of the present invention may be a liquid resin composition including a polyurethane resin selected according to a material of the substrate, a curing agent and an organic solvent. As an example, the polyurethane resin and the curing agent are dispersed in the organic solvent and diluted at an appropriate concentration, thereby preparing the polyurethane coating composition. As a preferable example, such an polyurethane coating composition may comprise: an polyurethane resin in an amount of 60-80 parts by weight; a curing agent in an amount of 0.1-3 parts by weight; and an organic solvent in an amount to balance the composition to 100 parts by weight, based on 100 parts by weight of the coating composition.

The curing agent and the organic solvent may be any of conventional ones known in the art without limitation. Non-liming examples of the solvent which can be used herein may be a ketone-based solvent such as methylethylketone (MEK), methylisobutylketone (MIBK) or acetone; an alcohol-based solvent such as isopropylalcohol (IPA) or n-hexanol; or 1,2-dichlorobenzen, N-methylpyrrolidone (NMP) or N,N-dimethylformamide (DMF). When necessary, the polyurethane coating composition may further include a reinforcing filling agent or weight filling agent, for example, colloidal silica, fumed silica; a coloring agent and a pigment; a thermal stabilizer, a UV stabilizer and a weather stabilizer; a flame retardant, a thickening agent, an herbicide or a preservative.

The viscosity of the polyurethane coating composition to use the knife coating method may be 1000 to 20000 cps, but the present invention is not particularly limited thereto. Here, the polyurethane coating composition may contain a polyurethane resin at 10 to 30 g/m$^2$.

The polyurethane coating layer formed as described above is exposed to air for sufficient time, thereby forming a cured film. Here, drying time and conditions may be adjusted within a conventional range. For example, the drying may be performed at room temperature or approximately 80 to 250° C. for 1 to 24 hours.

A second aqueous acrylic coating layer is formed by knife-coating an aqueous acrylic composition on the first polyurethane coating layer formed and drying the composition.

The aqueous acrylic coating composition according to the present invention may be a liquid resin composition comprising an acrylic resin selected according to a material of the substrate, a softening agent, an antifoaming agent and water. As a preferable example, such an aqueous acrylic coating composition may comprise: an acrylic resin in an amount of 30-50 parts by weight; a softening agent in an amount of 1-5 parts by weight; an antifoaming agent in an amount of 1-5 parts by weight; a water repellent (WR) agent in an amount of 1-5 parts by weight; and water in an amount to balance the composition to 100 parts by weight, based on 100 parts by weight of the coating composition.

In the formation of the second aqueous acrylic coating layer, knife coating, coating conditions and drying conditions may be the same as those used in the formation of the first polyurethane coating layer described above.

A third stain-resistant coating layer is formed by knife-coating a stain-resistant coating composition on the second aqueous acrylic coating layer formed and drying the composition.

A silicone resin generally has a high viscosity, and thus is not suitable for knife coating and does not easily form a uniform coating layer even if coated. For these reasons, in the present invention, the stain-resistant coating composition suitable for a knife-coating method may contain a silicone resin in a minor amount or further use an additive capable of reducing the viscosity of the silicone resin.

The stain-resistant coating composition according to the exemplary embodiment of the present invention may be a combination of (i) a polyurethane resin, (ii) a silicone resin, (iii) inorganic particles, and (iv) an organic solvent.

Specifically, the stain-resistant coating composition preferably comprises (i) a polyurethane resin in an amount of 20-40 parts by weight, (ii) a silicone resin in an amount of 1-10 parts by weight, (iii) inorganic particles in an amount of 1-10 parts by weight, and (d) an organic solvent in an amount to balance the stain-resistant coating composition to 100 parts by weight, based on 100 parts by weight of the stain-resistant coating composition.

The uniformly mixed stain-resistant coating composition preferably have a viscosity of 8,000 to 15,000 cps/25° C.

In the present invention, the stain-resistant coating composition may further comprise an additive capable of reducing the viscosity of the silicone resin. Non-liming examples of the additive which can be used herein may be at least one additive selected from the group consisting of oil, platinum and fluorine. There is no particular limitation in content of the additive as long as the additive is capable of reducing viscosity of the silicone resin in the stain-resistant coating composition.

Further, the stain-resistant coating composition may use a mixture of (i) a silicone resin with (ii) at least one additive selected from the group consisting of a polyurethane resin, oil, platinum and fluorine. For a mixture ratio of the stain-resistant coating composition, it is preferable that a silicone resin and an additive be mixed in a weight ratio of 100:20-30.

In the formation of the third stain-resistant coating layer, knife coating, coating conditions and drying conditions may be the same as those used in the formation of the polyurethane coating layer described above. Here, when the third stain-resistant coating layer is coated at least twice, a solid content of the stain-resistant coating composition in the second coating step may be lower than that in the first coating step.

Meanwhile, a step of dip-coating a fabric substrate coated with the first polyurethane coating layer in a solution containing a water repellent agent and drying the fabric substrate before or after step (i) of forming the first polyurethane coating layer. Through this step, a water repellent layer is formed on both surfaces of the fabric substrate.

The components or amounts of the solution containing the water repellent agent are not specifically limited, and may be appropriately adjusted within the range known in the art. For example, the solution may further comprise a water repellent agent, a softening agent, an aqueous acrylic binder and an anti-static agent commonly known in the art.

A preferable example of the solution containing the water repellent agent may include: a water repellent agent in an amount of 10 to 40 parts by weight; a softening agent in an amount of 1 to 10 parts by weight; an aqueous acrylic binder in an amount of 1 to 10 parts by weight; an anti-static agent in an amount of 0.1 to 3 parts by weight; and water in an amount to balance the composition to 100 parts by weight, based on 100 parts by weight of the composition.

Further, in the present invention, a step of back-coating an oil-based acrylic composition, the component of which is different from that of the second aqueous acrylic coating layer, on the second surface of the fabric substrate coated with the water repellent agent and drying the composition may be further included between (i) the step of forming the first polyurethane coating layer and (ii) the step of forming the second aqueous acrylic coating layer.

Here, the oil-based acrylic composition may be formed by using an acrylic resin alone, or comprising the acrylic resin, the styrene-butadiene rubber (SBR) and the organic solvent. A preferable example of the oil-based acrylic composition may be formed by comprising: an acrylic resin in an amount of 50 to 80 parts by weight; an SBR in an amount of 1 to 5 parts by weight; and an organic solvent in an amount to balance the composition to 100 parts by weight, based on 100 parts by weight of the composition.

The textile fabric sheet according to the exemplary embodiment of the present invention prepared as described above may have a structure in which the web structure of the fabric substrate woven with a fiber is preserved, and the reduction in air permeability of the final textile fabric sheet according to the introduction of the coating layer may be minimized.

The textile fabric sheet having stain and liquid resistance of the present invention configured as mentioned above may have three embodiments. However, the present invention is not restricted by the embodiments below, but various modifications and applications are possible based on need.

FIG. 1 is a cross-sectional view showing the first embodiment of the textile fabric sheet having stain and liquid resistance according to the present invention.

Here, the textile fabric sheet having stain and liquid resistance comprises a fabric substrate 110, which is a woven fabric, and a first polyurethane coating layer 120, a second aqueous acrylic coating layer 130 and a third stain-resistant coating layer 140, which are sequentially formed on the first surface of the fabric substrate.

FIG. 2 is a cross-sectional view showing the second embodiment of the textile fabric sheet having stain and liquid resistance according to the present invention.

Here, the textile fabric sheet having stain and liquid resistance has a structure, in which a first polyurethane coating layer 120, a water repellent layer 121, a second aqueous acrylic coating layer 130 and a third stain-resistant coating layer 140 are sequentially formed on the first surface of the fabric substrate 110, and a water repellent layer 121 and an oil-based acrylic back-coating layer 122 are formed on the second surface of the fabric substrate 110.

FIG. 3 is a cross-sectional view of a third embodiment of the textile fabric sheet having stain and liquid resistance according to the present invention.

Here, the textile fabric sheet having stain and liquid resistance has a structure, in which a first polyurethane coating layer 120, a water repellent layer 121, a second aqueous acrylic coating layer 130 and a third stain-resistant coating layer 140 are sequentially formed on the first surface of the fabric sheet 110, and a water repellent layer 121 is formed on the second surface of the fabric substrate 110.

Meanwhile, in the present invention, the first polyurethane coating layer 120, the second acrylic coating layer 130 and the third stain-resistant coating layer 140 are sequentially formed on the fabric substrate 110. However, the number and stacking sequence of coating layers constituting the textile fabric sheet having stain and liquid resistance may be freely selected according to a purpose, which is also included in the scope of the present invention. As an example, a multi-layered structure having at least three layers may be formed by changing the sequence of the coating layers 120, 130 and 140 or introducing a different surface layer.

The textile fabric sheet having stain and liquid resistance according to the exemplary embodiment of the present invention may be applied to various interior or exterior products. The interior products can be applied to all products to which the textile fabric sheet having stain and liquid resistance will be introduced, and unlimited examples thereof may include wall paper, furniture, flooring materials, interior materials, exterior materials, surface materials, wood or interior accessories.

Hereinafter, the present invention will be described in detail with reference to Examples. However, these Examples are merely provided to describe the present invention, not to limit the scope of the present invention.

Example 1

Preparation of Textile Fabric Sheet Having Stain and Liquid Resistance

A polyurethane coating composition (viscosity: 5000-7000 cps) including a polyurethane resin having a molecular weight of 20,000 to 200,000, a curing agent and an organic solvent mixed with a mixture of MEK, EA and TO was knife-coated in a range of 13 g/m$^2$ on a polyester fabric. Here, a width angle of the knife was 70 to 110 degrees, and drying was performed at 150° C. for 1 to 5 minutes, thereby forming a first polyurethane coating layer.

Thereafter, the polyester fabric was applied by dip-coating in a water repellent coating solution and dried. The water repellent agent was applied in a range of 3 g/m$^2$. The water repellent coating solution, in which a water repellent agent and water are contained in a weight ratio of 30:70 wt %, was used. The water repellent agent consists of a fluoride compound (perfluoro acrylate copolymer) of 15 wt %, a softening agent of 8 wt %, an aqueous acrylic binder of 5 wt % and an anti-static agent of 2 wt %.

Then, an acrylic resin composition is applied in a range of 10 g/m$^2$ on the water repellent layer of the polyester fabric on which a polyurethane coating layer is not formed, coated and dried to form an acrylic back-coating layer. The composition and amount of the acrylic resin composition are set forth in Table 1 below.

And an aqueous acrylic resin composition was knife-coated on the polyurethane coating layer of the polyester fabric and dried. The aqueous acrylic coating layer was applied in a range of 50 g/m$^2$. The composition and amount of the aqueous acrylic resin composition are set forth in Table 1 below.

Figures 4A, 4B:
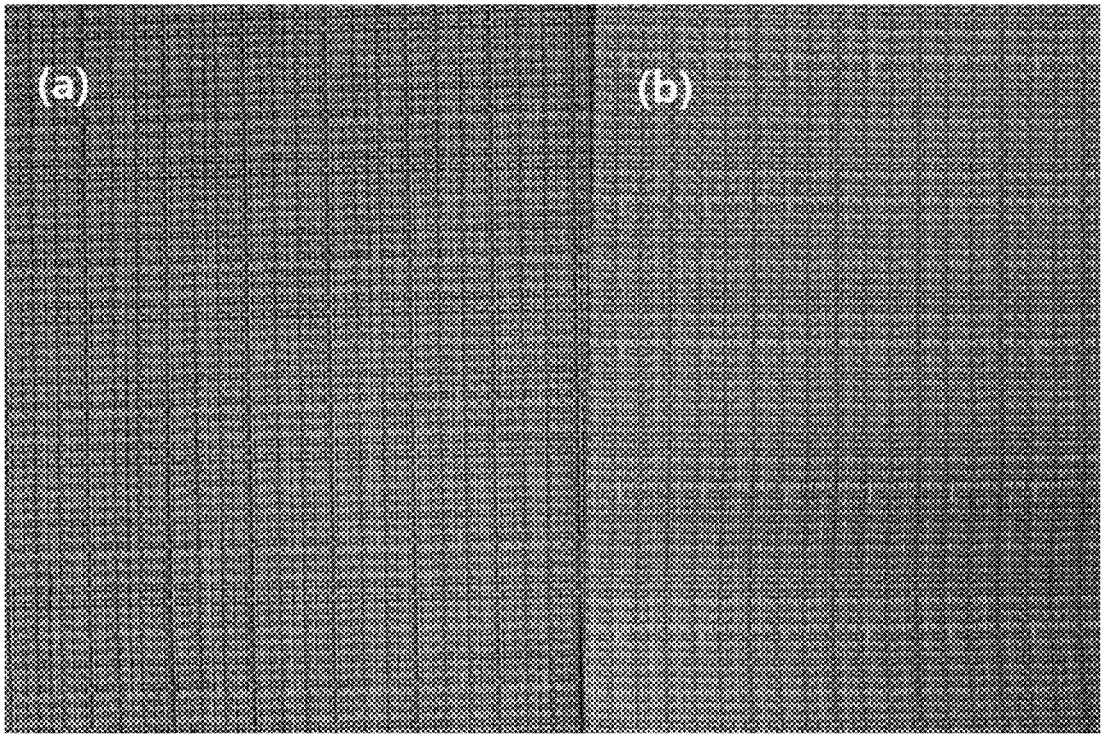
FIGS. 4(*a*) and (*b*) is a photograph showing a textile fabric sheet having stain and liquid resistance according to an embodiment of the present invention [FIG. 4(*a*): Example 1, FIG. 4(*b*): Example 3].

A stain-resistant coating composition, in which a polyurethane resin, a silicone resin, inorganic particles (silica) and an organic solvent were mixed in a weight ratio of 25:3:3:69, was knife-coated on the top of the coated aqueous acrylic coating layer, and dried to prepare a fabric sheet having stain and liquid resistance. The structure of the finally prepared textile fabric sheet having stain and liquid resistance is shown in FIG. 2, a photograph of which is FIG. 4(*a*).

Example 2

Preparation of a Textile Fabric Sheet Having Stain and Liquid Resistance (2)

Except that an oil-based acrylic back-coating (3) was not performed, a textile fabric sheet having stain and liquid resistance (2) was prepared in the same manner as in Example 1. The structure of the finally prepared textile fabric sheet having stain and liquid resistance is shown in FIG. 3.

Example 3

Preparation of a Textile Fabric Sheet Having Stain and Liquid Resistance (3)

Except that a water repellent coating (2) and an oil-based acrylic back-coating (3) were not performed, a textile fabric sheet having stain and liquid resistance (3) was prepared in the same manner as in Example 1. The structure of the finally prepared textile fabric sheet having stain and liquid resistance is shown in FIG. 1, a photograph of which is FIG. 4(*b*).

TABLE 1

| | Working Order | Composition | Amount (wt %) | Applying Amount (g/m$^2$) | Condition of Dryer Work (second/° C.) | Coating Method | Angle of Knife (°) |
|---|---|---|---|---|---|---|---|
| 1 | polyurethane coating | Polyurethane resin | 70 | 13 | 1$^{st}$: 30 sec/ 150° C. | Knife-coating | 70-110 |
| | | Curing agent | 1 | | 2$^{nd}$: 40 sec/ 150-170° C. | | |
| | | Solvent | 29 | | | | |
| 2 | Aqueous water-repellent coating | Water | 70 | 3 | 1$^{st}$: 30 sec/ 150° C. | Dip-coating | |
| | | Fluoride compound | 15 | | | | |
| | | Softening agent | 8 | | | | |
| | | Aqueous acrylic binder | 5 | | 2$^{nd}$: 1 min/ 170-180° C. | | |
| | | Anti-static agent | 2 | | | | |
| 3 | Oil-based acrylic back-coating | Acrylic resin | 67 | 10 | 1$^{st}$: 30 sec/ 150° C. | Knife-coating | 70-110 |
| | | Toluene | 30 | | 2$^{nd}$: 40 sec/ 150-170° C. | | |
| | | SBR | 3 | | | | |
| 4 | Aqueous acrylic coating | Water | 60 | 50 | 1$^{st}$: 30 sec/ 150° C. | Knife-coating | 70-110 |
| | | Acrylic resin | 34 | | 2$^{nd}$: 40 sec/ 170-175° C. | | |
| | | Softening agent | 2 | | | | |
| | | Antifoaming agent | 2 | | | | |
| | | WR | 2 | | | | |
| 5 | Stain-resistant coating | DMF | 29 | 19 | 1$^{st}$: 20 sec/ 100° C. | Knife-coating | 70-110 |
| | | MEK | 40 | | | | |
| | | Silicone resin | 3 | | | | |

TABLE 1-continued

| Working Order | Composition | Amount (wt %) | Applying Amount ($g/m^2$) | Condition of Dryer Work (second/° C.) | Coating Method | Angle of Knife (°) |
|---|---|---|---|---|---|---|
| | Silica<br>Polyurethane resin | 3<br>25 | | $2^{nd}$: 40 sec/<br>170-175° C. | | |

The above applying amount is based on the amount applied to a polyester fabric of 129 $g/m^2$, and may vary depending on the weight of the fabric.

TABLE 2

| | Components | Manufacturer/Model |
|---|---|---|
| 1 polyurethane coating | Polyurethane resin | Hanjin Chemical Corporation/ AG-100 |
| | Curing agent | Kukdo Chemical Co., Ltd./K-100 |
| | Solvent | Dong-A Chemical Co., Ltd. |
| 2 Aqueous water repellent coating | Fluoride compound | Namyung/NY-732FU |
| | Softening agent | Taekang/DK-100 |
| | Aqueous acrylic binder | Young Woo/AK-905 |
| | Anti-static agent | Taekang/DK-200 |
| 3 Oil-based acrylic back-coating | Acrylic agent | Young Woo/AK-906 |
| | Toluene | Dong-A 1.Chemical Co., Ltd./ DM-100 |
| | SBR | Young Woo/KSL-106 |
| 4 Aqueous acrylic coating | Acrylic resin | Young Woo/AK-905 |
| | Softening agent | Taekang/DK-100 |
| | Antifoaming agent | Lucky/101A |
| | Water repellent (WR) | Namyung/NY732FU |
| 5 Stain-resistant coating | DMF | Dong-A Chmeical Co., Ltd./DM-100 |
| | MEK | Dong-A Chemcial Co., Ltd./MK-100 |
| | Silicone resin | Songjung/Si-52 |
| | Silica | Songjung/SK-40 |
| | Polyurethane resin | Songjung/SAG-420 |

Experimental Example 1

Evaluation of Physical Property of Textile Fabric Sheet Having Stain and Liquid Resistance 1) Evaluation of Stain Resistance Evaluation of stain resistance was performed using the textile fabric sheet having stain and liquid resistance prepared in Examples 1 and 3.

The evaluation method was repeatedly performed 50 times using the same stains to evaluate a degree of staining by eyes. Here, as the stains, an oil-based ballpoint pen, mustard and a ketchup, stains from which are the most difficult to prevent, were used. In addition, as a control group, a fabric sheet currently produced by Crypton was used.

Figure 5:
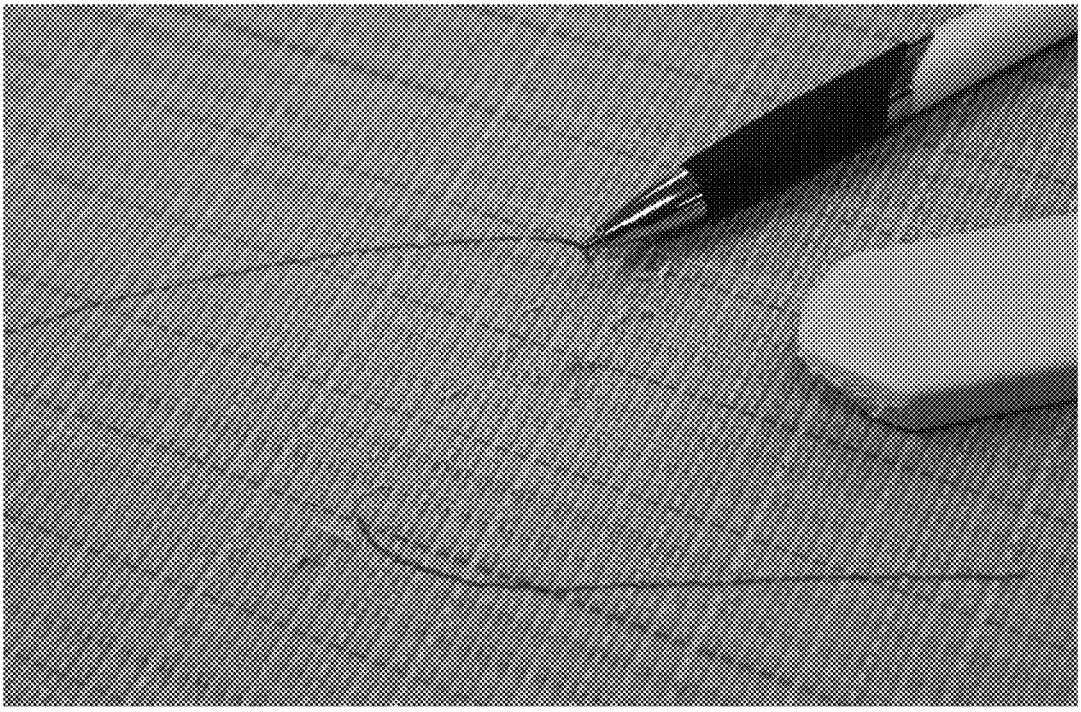
FIG. 5 is a photograph showing the result of evaluating stain resistance of a stain source (an oil-based pen) of the textile fabric sheet having stain and liquid resistance manufactured in Example 1.
Figure 6:
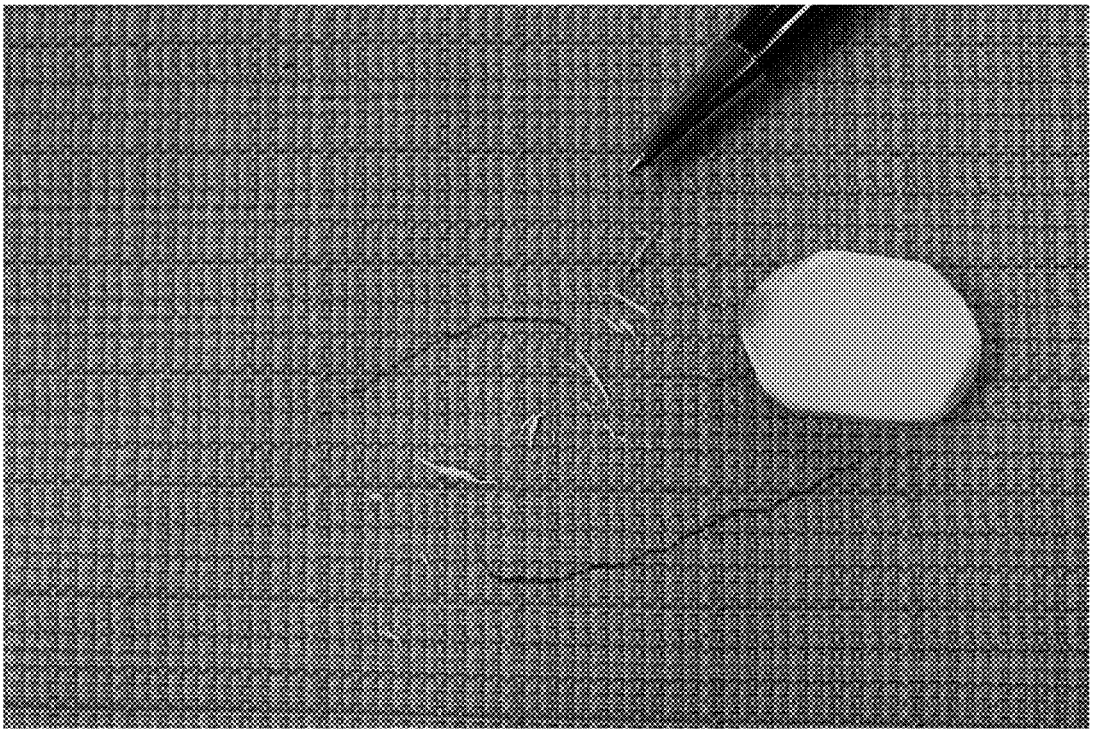
FIG. 6 is a photograph showing the result of evaluating stain resistance of a stain source (an oil-based pen) of the textile fabric sheet having stain and liquid resistance manufactured in Example 3.
Figure 7:
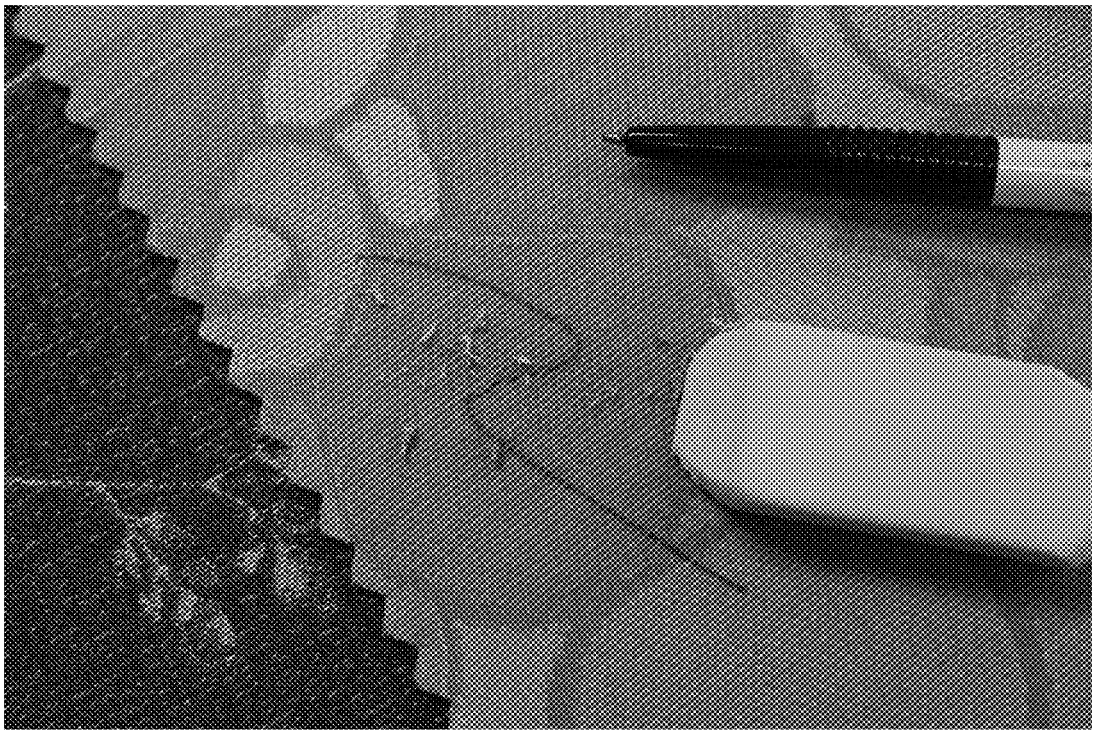
FIG. 7 is a photograph showing the result of evaluating stain resistance of a stain source (an oil-based pen) of the conventional fabric sheet having stain and liquid resistance.

As a result of experimentation, the oil-based ballpoint pen on the textile fabric sheets in Examples 1 and 3 was easily removed with an eraser and a fabric or paper towel without using a specific cleaner (see FIGS. 5 and 6). On the contrary, it was impossible to remove the ballpoint pen on the fabric sheet of Crypton in the same manner as in Examples 1 and 3 (see FIG. 7).

Figure 8:
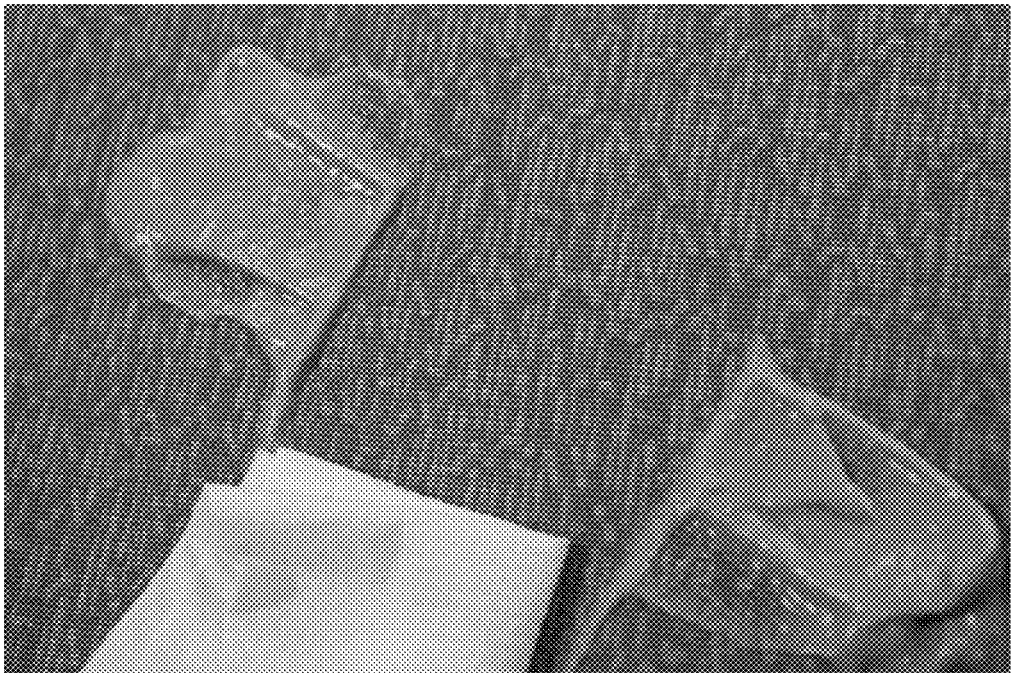
FIG. 8 is a photograph showing the result of evaluating stain resistance of a stain source (a mustard) of the textile fabric sheet having stain and liquid resistance manufactured in Example 1.
Figure 9A:
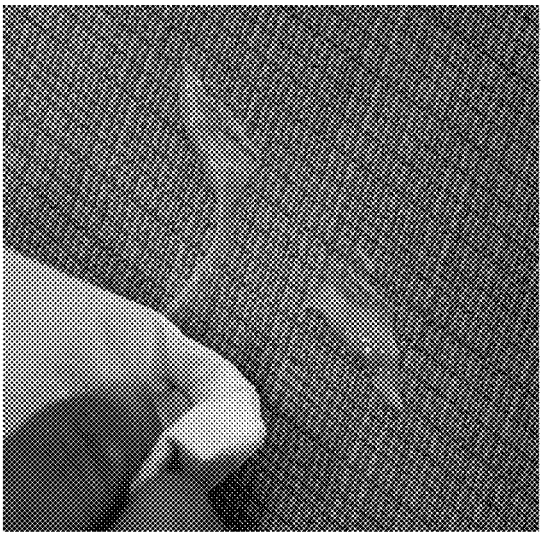
FIGS. 9(*a*) and (*b*) are photographs showing the result of evaluating stain resistance of a stain source (a mustard) of the textile fabric sheet having stain and liquid resistance manufactured in Example 3.
Figure 9B:
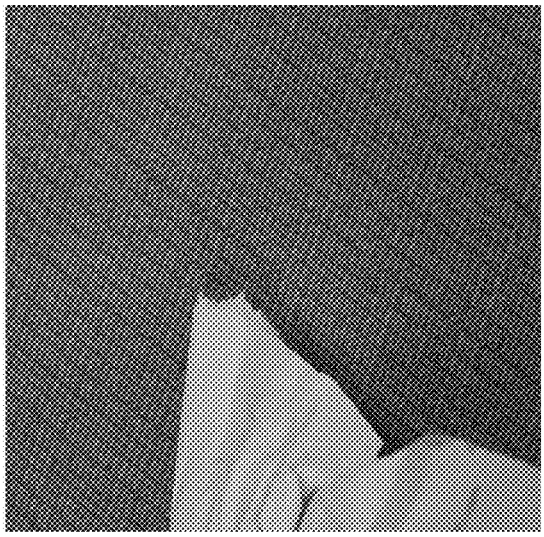
Figure 10A:
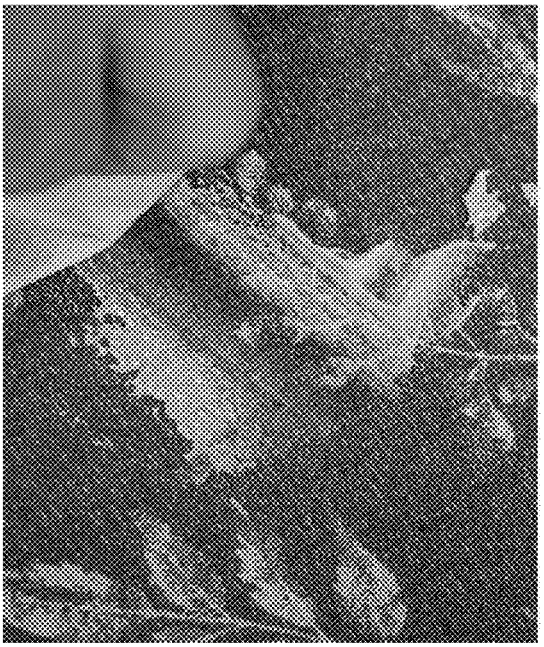
FIGS. 10(*a*) and (*b*) are photographs showing the result of evaluating stain resistance of a stain source (a mustard) of the conventional fabric sheet having stain and liquid resistance.
Figure 10B:
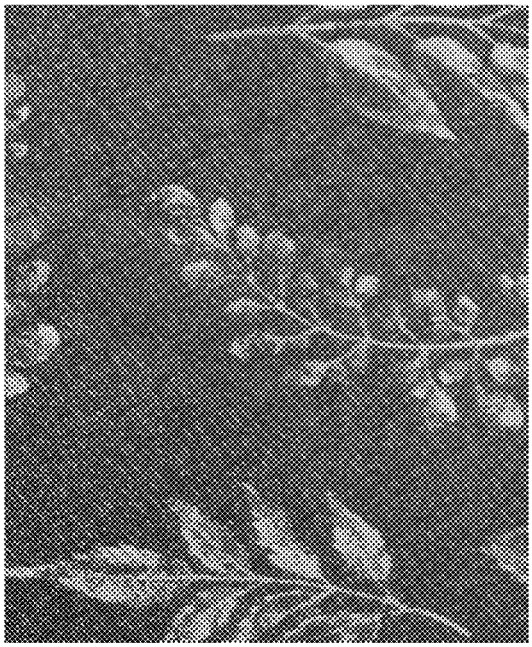
Figure 11:
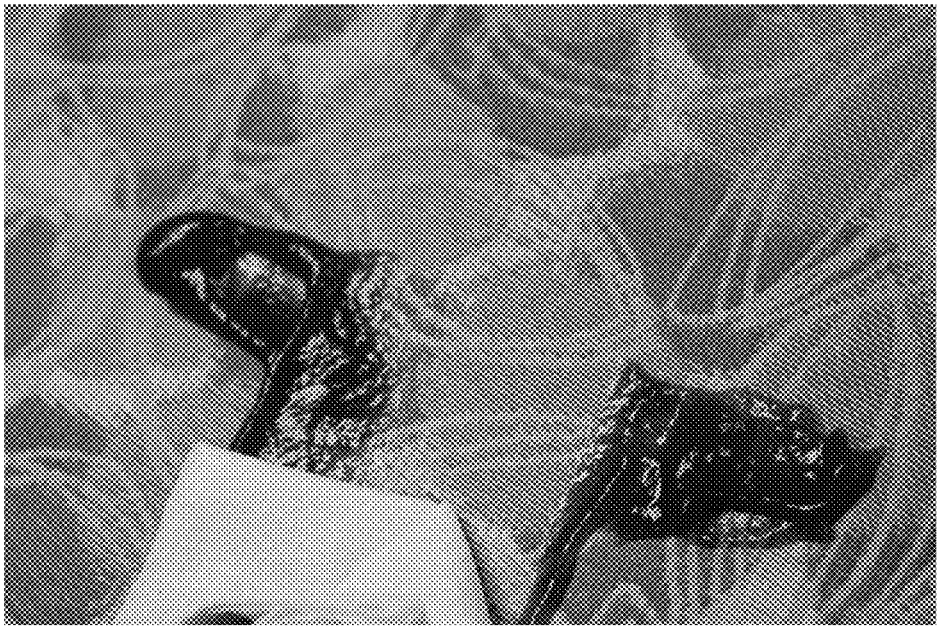
FIG. 11 is a photograph showing the result of evaluating stain resistance of a stain source (a ketchup) of the textile fabric sheet having stain and liquid resistance manufactured in Example 1.
Figure 12A:
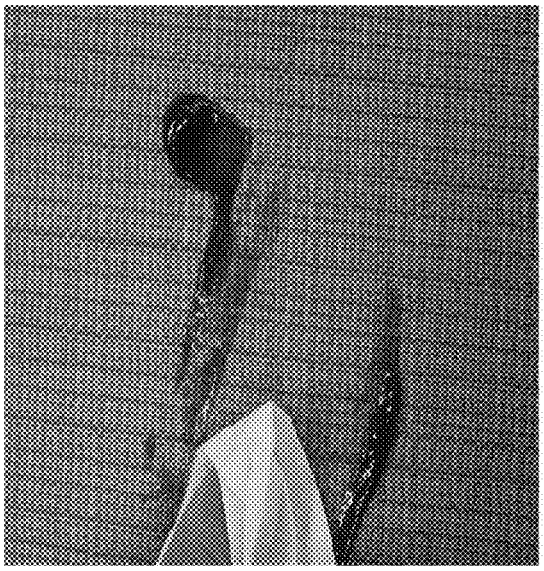
FIGS. 12(*a*) and (*b*) are photographs showing the result of evaluating stain resistance of a stain source (a ketchup) of the textile fabric sheet having stain and liquid resistance manufactured in Example 3.
Figure 12B:
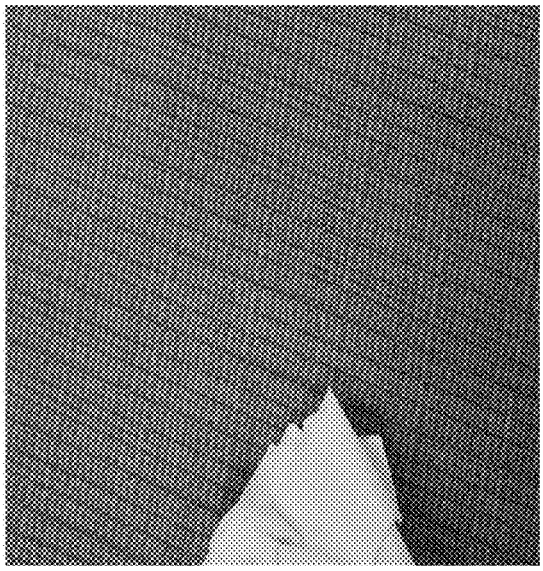
Figure 13A:
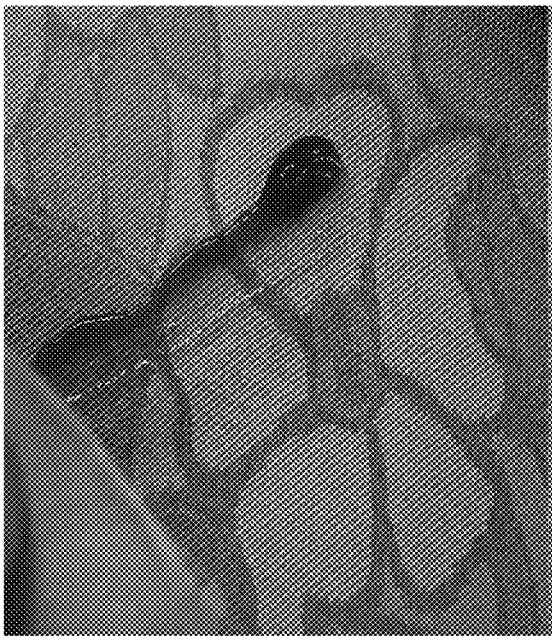
FIGS. 13(*a*) and (*b*) are photographs showing the result of evaluating stain resistance of a stain source (a ketchup) of the conventional fabric sheet having stain and liquid resistance.
Figure 13B:
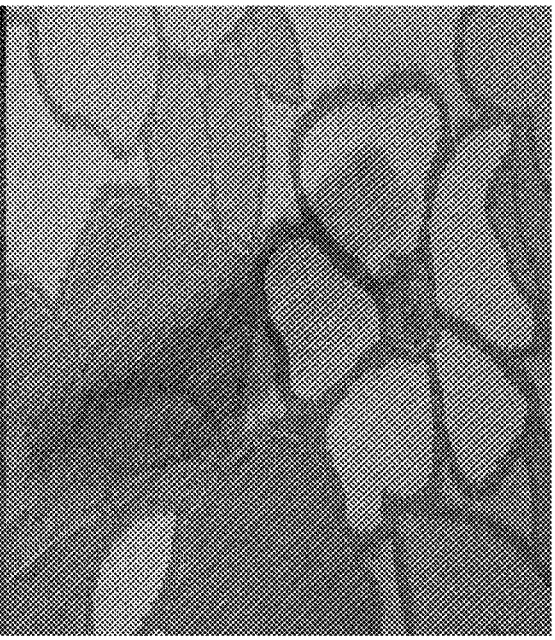

The mustard and ketchup stains on the textile fabric sheets in Examples 1 and 3 was completely removed with an eraser and a fabric or paper towel without using a specific cleaner (see FIGS. 8, 9(*a*), 9(*b*), 11, 12(*a*) and 12(*b*)). On the contrary, the mustard and ketchup stains, which are stain sources, were left on the fabric sheet of Crypton (see FIGS. 10(*a*), 10(*b*), 13(*a*) and 13(*b*)). Therefore, it can be noted that the textile fabric sheet of the present invention had a more excellent stain resistant effect than the control group.

2) Evaluation of Water Repellent

Evaluation of water repellent was performed using the textile fabric sheet having stain and liquid resistance prepared in Examples 1 and 3.

The evaluation method was performed using coffee to evaluate the shape of the instilled coffee and/or the absorption degree of the textile fabric sheet by eyes after instillation of water into the textile fabric sheet.

Here, coffee has a better penetration effect than water, and thus, was used as a material to evaluate water repellent in the subject application.

Figure 14:
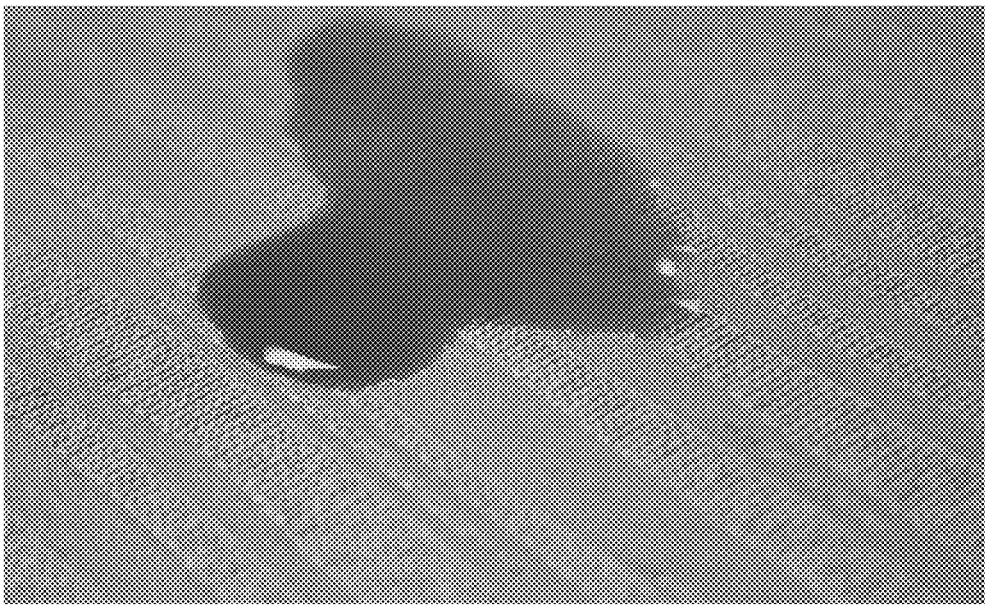
FIG. 14 is a photograph showing the result of evaluating water repellent of the textile fabric sheet having stain and liquid resistance manufactured in Example 1.
Figure 15A:
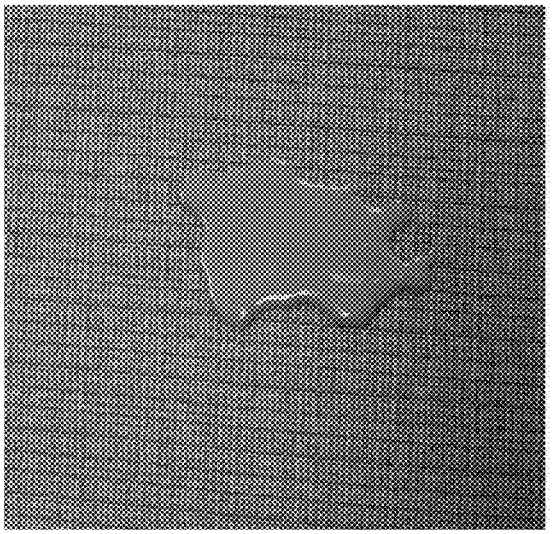
FIGS. 15(*a*) and (*b*) are photographs showing the result of evaluating water repellent of the textile fabric sheet having stain and liquid resistance manufactured in Example 3.
Figure 15B:
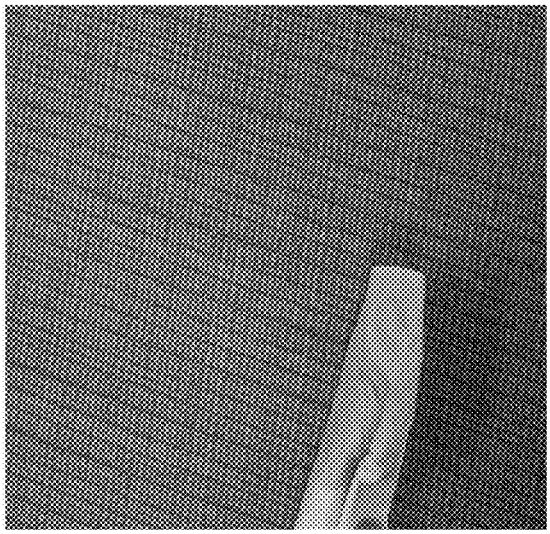

As a result, the instilled coffee on the fabric sheet prepared in Examples 1 and 3 existed maintaining the fundamental shape thereof as time passed and was not absorbed into the fabric sheet. Therefore, it can be noted that the fabric sheet of the present invention had an excellent water repellent effect (see FIGS. 14, 15(*a*) and 15(*b*)).

3) Evaluation of Wear Resistance (Friction Fastness)

The textile fabric sheet having a stain and liquid resistance of Examples 1 to 3 were tested according to an ASTM D4157 Wyzenbeek method. Here, as a control group, fabric sheets produced by Crypton used in the Evaluation of Stain Resistance were used.

Generally, when a result of the wear resistance test was 30000 rubs or more, it was indicated as heavy duty, and when a result of the wear resistance test was more than 50000 rubs, it is determined as commercially suitable.

The results of the test were that the fabric sheet produced by Crypton withstood 80000 rubs (1) and 50000 rubs (2), respectively, and the textile fabric sheet having stain and liquid resistance of the present invention withstood more than 200000 rubs. It can be confirmed that, regardless of abrasion of the textile, due to the polyurethane coating layer formed on its surface, the wear resistant effect was drastically improved.

4) Evaluation of Wear Resistance (Friction Fastness) (2)

Evaluation of wear resistance was performed at Diverisified Testing Laboratories, INC. using various textile fabric sheets prepared in above Examples. The textile fabric sheets were tested according to an ASTM D4157-10 Oscillatory Cylinder Method (Standard Test Method for Abrasion Resistance of Textile Fabrics). And the Evaluation of wear resistance was performed in the condition of abradant: #8 Cotton duck; tension: 4 lb; load: 3 lb.

As a result, the textile fabric sheet having stain and liquid resistance of the present invention withstood more than 200,000 rubs. Therefore, it can be noted that the textile fabric sheet of the present invention had an excellent wear resistance effect (see Table 1).

TABLE 1

| Sample | Test Results |
|---|---|
| ZENUS ® KASKADE | Passed 200,000 Cycles |
| ZENUS ® MOSAIC | Passed 200,000 Cycles |

TABLE 1-continued

| Sample | Test Results |
|---|---|
| ZENUS ® VENDETTA | Passed 200,000 Cycles |
| ZENUS ® CITADEL | Passed 200,000 Cycles |
| ZENUS ® ORACLE | Passed 200,000 Cycles |
| ZENUS ® IGUAZU | Passed 200,000 Cycles |
| ZENUS ® ASTORIA | Passed 200,000 Cycles |
| ZENUS ® TRANQUIL | Passed 200,000 Cycles |
| ZENUS ® CALICUT | Passed 200,000 Cycles |

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A textile fabric sheet having stain and liquid resistance, comprising:

(a) a fabric substrate;

(b) a first polyurethane coating layer formed on a first surface of the fabric substrate;

(c) a second aqueous acrylic coating layer formed on the first coating layer of the polyurethane coating layer; and (d) a third stain-resistant coating layer formed on the second aqueous acrylic coating layer, wherein the first polyurethane coating layer (b) is formed from a composition consisting of a polyurethane resin, a curing agent and an organic solvent;

the second aqueous acrylic coating layer (c) is formed from a composition consisting of an acrylic resin, a softening agent, an antifoaming agent, a water repellent agent and water; and an amount of the second aqueous acrylic coating layer ranges from 25 g/m$^2$ to 75 g/m$^2$, and the third stain-resistant coating layer is formed from a composition consisting of a polyurethane resin, a silicone resin, inorganic particles, and an organic solvent.

2. The textile fabric sheet of claim 1, wherein the fabric substrate is a woven or non-woven fabric composed of at least one selected from the group consisting of a polyester fiber, a viscose rayon fiber, a polyamide fiber, a polyurethane fiber, an acrylic fiber, a polyolefin fiber and a cellulose fiber.

3. The textile fabric sheet of claim 1, wherein an applying amount of the polyurethane rein in the first polyurethane coating layer ranges from 10 g/m$^2$ to 30 g/m$^2$.

4. The textile fabric sheet of claim 1, wherein an applying amount of the third stain-resistant coating layer (d) ranges from 10 g/m$^2$ to 30 g/m$^2$.

5. The textile fabric sheet of claim 1, wherein the textile fabric sheet further comprises a water repellent layer (e) between the first polyurethane coating layer (b) and the second aqueous acrylic coating layer; and on the second surface of the fabric substrate.

6. The textile fabric sheet of claim 5, wherein the water repellent layer (e) comprises a silicone-based water repellent agent, a fluorine-based water repellent agent or both of them, and an applying amount of the water repellent agents ranges from 1 g/m$^2$ to 10 g/m$^2$.

7. The textile fabric sheet of claim 5, wherein the textile fabric sheet further comprises an oil-based acrylic back-coating layer (f), the component of which is different from the second aqueous acrylic coating layer (c), on the water repellent layer (e) formed on the second surface of the fabric substrate (a).

8. The textile fabric sheet of claim 7, wherein an applying amount of the oil-based acrylic back-coating layer (f) ranges from 1 g/m$^2$ to 15 g/m$^2$.

9. A method of preparing a textile fabric sheet having stain and liquid resistance of claim 1, comprising:

(i) knife-coating a polyurethane coating composition on a first surface of the fabric substrate at least once and drying the polyurethane coating composition;

(ii) knife-coating an aqueous acrylic coating composition on the top of the above-coated first polyurethane coating layer at least once and drying the aqueous acrylic coating composition; and (iii) knife-coating a stain-resistant coating composition on the top of the above-coated second aqueous acrylic coating layer at least once and drying the stain-resistant coating composition.

10. The method of preparing a textile fabric sheet of claim 9, wherein at least one knife-coating is performed in steps (i) to (iii), wherein a width angle of the knife ranges from 50° to 150°.

11. The method of preparing a textile fabric sheet of claim 9, wherein the polyurethane coating composition in step (i) comprises: a polyurethane resin in an amount of 60-80 parts by weight; a curing agent in an amount of 0.1-3 parts by weight; and an organic solvent in an amount to balance the composition to 100 parts by weight, based on 100 parts by weight of the composition.

12. The method of preparing a textile fabric sheet of claim 9, wherein the aqueous acrylic coating composition in step (iii) comprises: an acrylic resin in an amount of 30-50 parts by weight; a softening agent in an amount of 1-5 parts by weight; an antifoaming agent in an amount of 1-5 parts by weight; a water repellent agent in an amount of 1-5 parts by weight; and water in an amount to balance the composition to 100 parts by weight, based on 100 parts by weight of the composition.

13. The method of preparing a textile fabric sheet of claim 9, wherein the stain-resistant coating composition comprises:

(i) a polyurethane resin in an amount of 20-40 parts by weight;

(ii) a silicone resin in an amount of 1-10 parts by weight;

(iii) inorganic particles in an amount of 1-10 parts by weight; and (iv) an organic solvent in an amount to balance the composition to 100 parts by weight, based on 100 parts by weight of the composition.

14. The method of preparing a textile fabric sheet of claim 9, wherein the method further comprises a step of dip-coating a fabric substrate coated with the first polyurethane coating layer in a solution containing a water repellent agent and drying the substrate before or after step (i).

15. The method of preparing a textile fabric sheet of claim 14, wherein the method further comprises a step of back-coating an oil-based acrylic composition, the component of which is different from the second aqueous acrylic coating layer, on the second surface of the fabric substrate coated with the water repellent agent and drying the oil-based acrylic composition between step (i) and step (ii).

* * * * *